US005179765A

United States Patent [19]

Sungberg

[11] Patent Number: 5,179,765

[45] Date of Patent: Jan. 19, 1993

[54] PLASTIC PAPER CLIP

[76] Inventor: Carl B. Sungberg, 179 Reimers Rd., Monson, Mass. 01057

[21] Appl. No.: 818,147

[22] Filed: Jan. 8, 1992

[51] Int. Cl.[5] ..... B43F 1/02

[52] U.S. Cl. ..... 24/67.9; 24/3 M; 24/3 K; 24/67.1

[58] Field of Search ..... 24/67.9, 67 R, 67.1, 24/67.3, 67.5, 67.11, 545, 546, 549, 3 K, 3 M

[56] References Cited

U.S. PATENT DOCUMENTS

| | | | |
|---|---|---|---|
| 547,647 | 10/1895 | Lehmann | 24/67.1 |
| 1,264,295 | 4/1918 | Greene | 24/3 M |
| 2,121,440 | 6/1938 | Morrison | 24/3 K |
| 2,341,121 | 2/1944 | Schaaff | 24/67.9 |
| 2,613,422 | 10/1952 | Boden et al. | 24/3 K |
| 2,843,900 | 7/1958 | Nye . | |
| 3,137,934 | 6/1964 | Rhoads | 24/67.9 |
| 4,011,673 | 3/1977 | Levine | 24/67.9 |
| 4,055,874 | 11/1977 | Brown | 24/67.9 |
| 4,170,052 | 10/1979 | Okerblom | 24/67.9 |
| 4,470,180 | 9/1984 | Blomgren | 24/30.5 P |
| 4,706,342 | 11/1987 | Yu | 24/67.9 |
| 5,002,249 | 3/1991 | Meyer | 24/67.9 |
| 5,010,629 | 4/1991 | Hirzel | 24/67.9 |
| 5,022,124 | 6/1991 | Yiin | 24/67.9 |

FOREIGN PATENT DOCUMENTS

| | | | |
|---|---|---|---|
| 1489764 | 6/1967 | France | 24/67.9 |

*Primary Examiner*—Victor N. Sakran
*Attorney, Agent, or Firm*—John H. Crozier

[57] ABSTRACT

In a preferred embodiment a plastic paper clip having a generally flat, horizontal, relatively rigid, base gripping member having an opening defined therein and a generally flat, generally horizontal, relatively rigid, upper gripping member fitable within said opening, the proximal end of said upper gripping member being attached to said lower gripping member by a vertical joining member such that said proximal end of said upper gripping member and said lower gripping member are spaced apart at the throat formed therebetween.

5 Claims, 2 Drawing Sheets

PLASTIC PAPER CLIP

BACKGROUND OF THE INVENTION

1. Field of the Invention

The present invention relates to paper clips generally and, more particularly, but not by way of limitation, to a novel paper clip formed of a polymeric material, which paper clip can hold a relatively large number of sheets of paper.

2. Background Art

Paper clips are well known articles for temporarily joining together multiple sheets of paper or similar materials. Paper clips have been made in a number of configurations and have mainly been formed of metallic materials. While metallic paper clips perform satisfactorily, they are relatively expensive and many have the disadvantage that they tend to rust over a period of time, thus discoloring the papers to which they are attached. Also, metallic paper clips can damage certain items such as photographs.

In order to lower the cost of paper clips, attempts have been made to make the paper clips from moldable polymeric materials, A substantial disadvantage of such known plastic paper clips is that they do not hold more than a few sheets of paper and, even when attached to only a few sheets, they easily slip therefrom. This results primarily from the fact that the two halves of such a paper clip form a "V" shape which introduces a component of force tending to push the paper clip from the ends of the papers.

Accordingly, it is a principal object of the present invention to provide a plastic paper clip that can hold a relatively large number of sheets of paper without easily slipping therefrom.

It is an additional object of the invention to provide such a paper clip that is easily and economically manufactured.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment a plastic paper clip having a generally flat, horizontal, relatively rigid, base gripping member having an opening defined therein and a generally flat, generally horizontal, relatively rigid, upper gripping member fitable within said opening, the proximal end of said upper gripping member being attached to said lower gripping member by a vertical joining member such that said proximal end of said upper gripping member and said lower gripping member are spaced apart at the throat formed therebetween.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, in which.

DETAILED DESCRIPTION OF THE PREFERRED EMBODIMENTS

Figure 1:
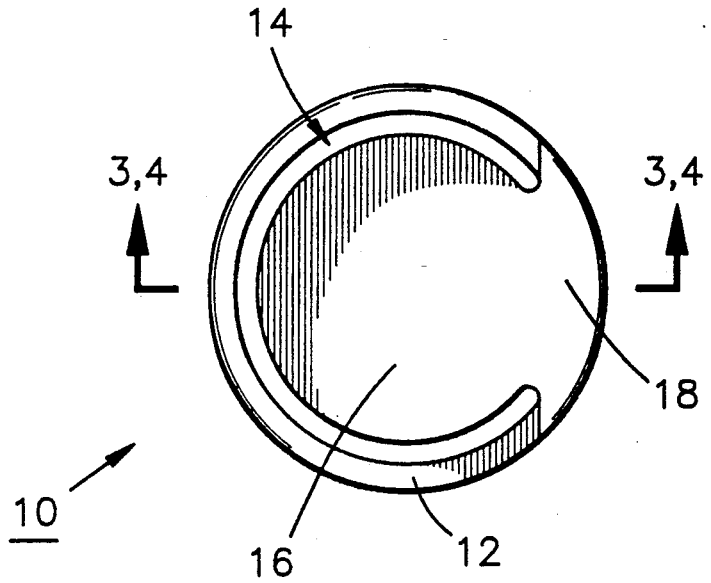
FIG. 1 is a top plan view of a plastic paper clip constructed according to the present invention.
Figure 2:
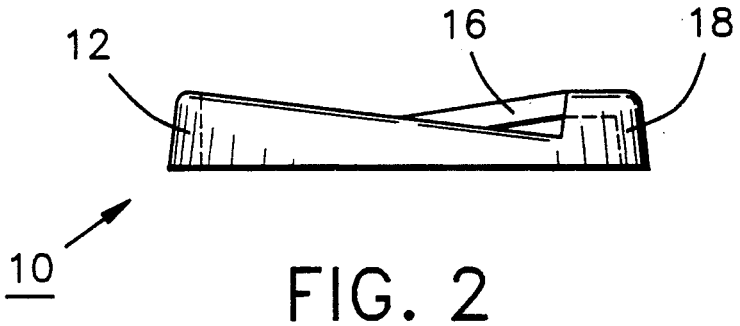
FIG. 2 is a side elevational view of the paper clip of FIG. 1.
Figure 3:
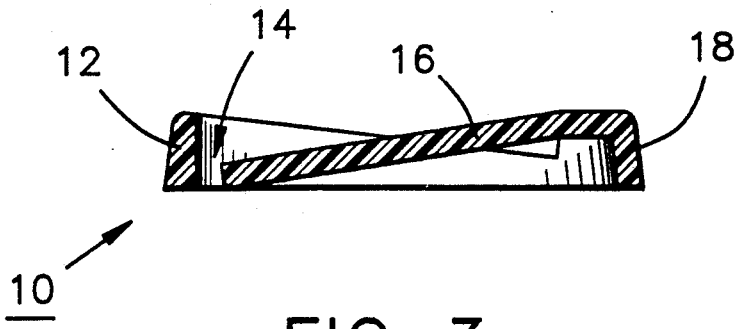
FIG. 3 is a side elevational, cross-sectional view taken along line "3—3" of FIG. 1.

Referring now the Drawing, provided for purposes of illustration only and not intended to be a limitation on the invention described herein, in which similar or identical elements are given consistent identifying numerals throughout the various figures thereof, FIGS. 1-3 illustrate one embodiment of a plastic paper clip constructed according to the present invention, generally indicated by the reference numeral 10.

Paper clip 10 includes a generally flat, relatively rigid, base gripping member 12 having an opening 14 defined therein. Disposed within opening 14 is a generally flat, relatively flexible, upper gripping member 16. The proximal end of upper gripping member 16 is attached to base gripping member 12 by a joining portion 18 at the upper surface of the base gripping member which joining portion extends along and joins approximately one-fourth the perimeter of the upper gripping member.

It can be seen that upper gripping member 16 is inclined with respect to base gripping member 12 such that the distal end of the upper gripping member extends to the plane of the lower surface of the base gripping member when paper clip 10 is not in use.

Figure 4:
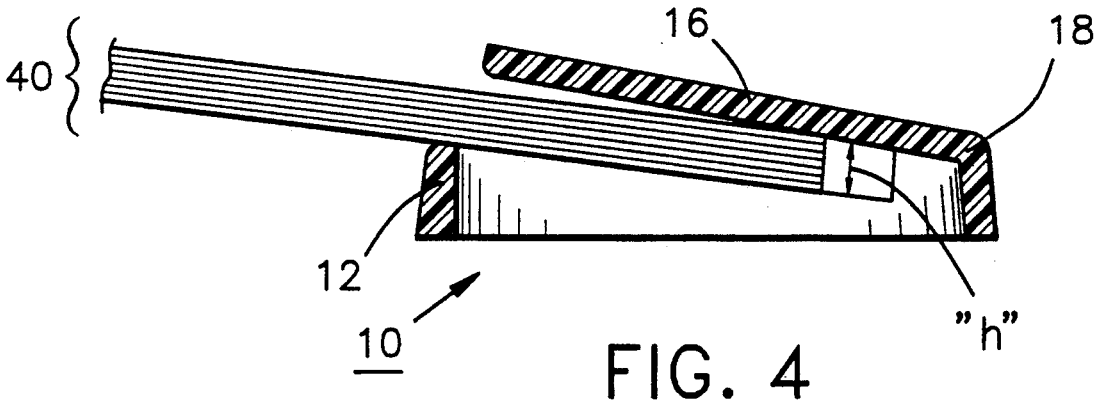
FIG. 4 is a side elevational, cross-sectional view taken along line "4—4" of FIG. 1, with papers inserted in the paper clip.

FIG. 4 illustrates the use of paper clip 10 in holding a plurality of papers. It can be seen that upper gripping member 16 has been bent upwardly from base gripping member 12 so that the distal end of the upper gripping member is above the plane of the upper surface of the base gripping member. Papers 40 are inserted between base gripping member 12 and upper gripping member 16 and the latter is released, the spring force between the members holding the papers in place. The optimum maximum total thickness of papers that can be held by paper clip 10 is equal to or less than the height "h" of the throat defined between base and upper gripping members 12 and 16, although greater thicknesses can be accommodated.

Figure 5:
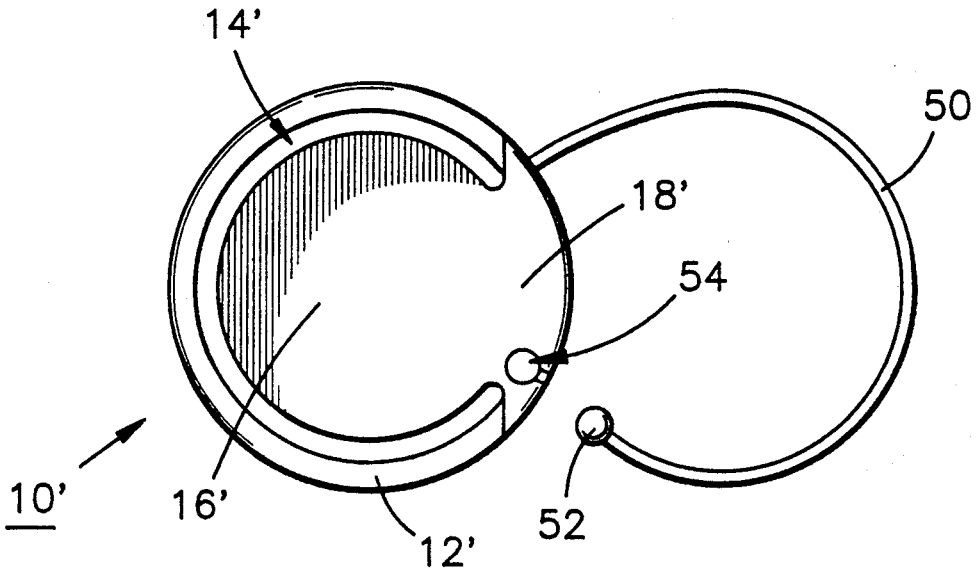
FIG. 5 is a top plan view of a plastic paper clip constructed according to the present invention with a strap attached thereto.

FIG. 5 illustrates an alternative embodiment of the present invention, generally indicated by the reference numeral 10'. Paper clip 10' includes a strap 50 fixedly attached at one end to base gripping member 12' and releasably attachable at the other end to the base gripping member by means of a ball 52 deformably insertable into a cavity 54 defined in the base gripping member.

Figure 6:
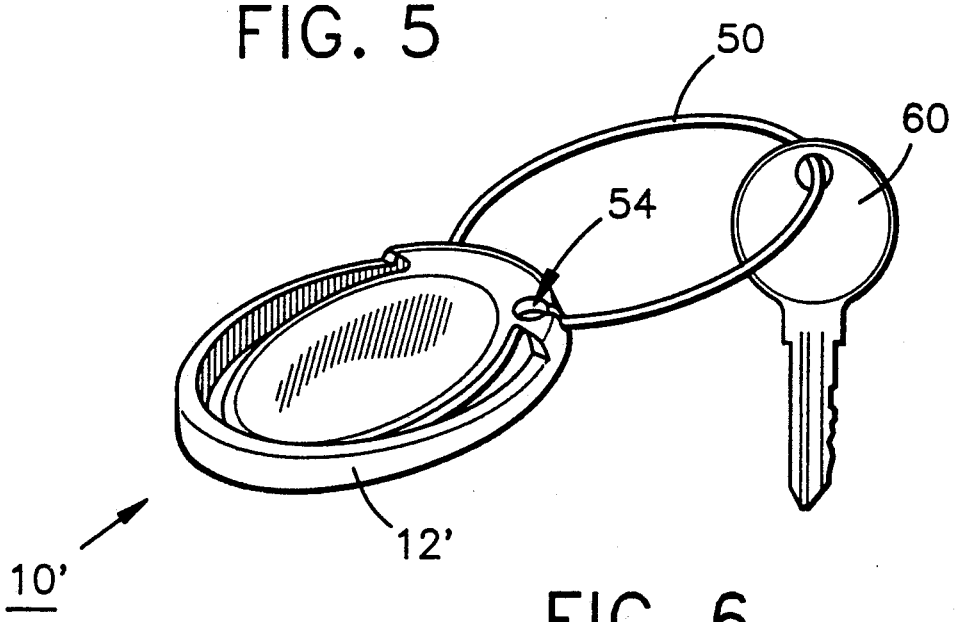
FIG. 6 is a top/side perspective view of the paper clip of FIG. 5 with the strap inserted through a key.

Strap 50 may be used for a variety of purposes and may be used for holding one or more keys, such as key 60 shown on FIG. 6. This embodiment is especially useful in the context of automobile repair shops where paper clip 10' can be employed to hold both a customer's keys and the repair order papers (papers not shown).

Paper clips 10 and 10' may be easily and economically manufactured from polypropylene by conventional injection molding techniques.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A plastic paper clip, comprising:

(a) a generally flat, horizontal, relatively rigid, base gripping member, having a tapered planar paper engaging upper surface and a flat lower surface, and having an opening defined therein;

(b) a generally flat, generally horizontal, relatively rigid, upper gripping member fitable within said opening and having upper and lower surfaces, the proximal end of said upper gripping member being attached to said lower gripped member by a vertical joining member such that said proximal end of said upper gripping member and said lower gripping member are spaced apart at a C-shaped throat formed therebetween; and (c) the distal end of said upper gripping member being inclined into said base gripping member such that said lower surface of said upper gripping member at the distal end thereof lies substantially in the plane of said lower surface of said base member when said paper clip is not in use.

2. A plastic paper clip, as defined in claim 1 wherein said lower and upper gripping members are circular.

3. A plastic paper clip, as defined in claim 2, wherein said joining member joins said lower and upper gripping members along approximately one-fourth the circumferences thereof.

4. A plastic paper clip, as defined in claim 1, further comprising a strap attached to said plastic paper clip so as to form a loop for insertion through an article such as a vehicle ignition key, one end of said strap being integral with said paper clip and the other end of said strap having a spherical termination, said spherical termination being releasably insertable in an open spherical cavity by the resilient deformation of said spherical termination as said spherical termination is inserted therein.

5. A plastic paper clip, as defined in claim 1, wherein said base member is substantially cylindrical.

* * * * *